US007237757B2

(12) United States Patent
Wakura

(10) Patent No.: US 7,237,757 B2
(45) Date of Patent: Jul. 3, 2007

(54) ARTICLE SUPPORT

(75) Inventor: Hiroshi Wakura, Ichikawa (JP)

(73) Assignee: Wayo Co., Ltd, Tokyo (JP)

( * ) Notice: Subject to any disclaimer, the term of this patent is extended or adjusted under 35 U.S.C. 154(b) by 136 days.

(21) Appl. No.: 10/487,028

(22) PCT Filed: Sep. 14, 2001

(86) PCT No.: PCT/JP01/08001

§ 371 (c)(1),
(2), (4) Date: Feb. 17, 2004

(87) PCT Pub. No.: WO03/024284

PCT Pub. Date: Mar. 27, 2003

(65) Prior Publication Data

US 2004/0232304 A1 Nov. 25, 2004

(51) Int. Cl.
*A47G 1/24* (2006.01)

(52) U.S. Cl. ..... 248/454; 248/441.1

(58) Field of Classification Search ..... 248/441.1, 248/442, 447, 454, 455, 458, 460, 481, 288.31, 248/288.51, 558; 403/56, 76, 90, 114, 115, 403/122

See application file for complete search history.

(56) References Cited

U.S. PATENT DOCUMENTS 431,036 A * 7/1890 Dawson ..... 248/454
1,692,337 A * 11/1928 Forbes ..... 248/445
1,739,909 A * 12/1929 Livergood ..... 248/104
1,904,088 A * 4/1933 Schutz ..... 248/455
2,464,690 A * 3/1949 Ketchem ..... 108/29
2,565,446 A * 8/1951 Abbott ..... 355/47
3,276,761 A * 10/1966 Orchard ..... 248/121
3,529,374 A * 9/1970 Spertus ..... 40/730
3,809,352 A * 5/1974 Mathias ..... 248/444.1
4,374,497 A * 2/1983 Harmand ..... 108/4
4,383,722 A 5/1983 Weber
4,620,687 A * 11/1986 Bishop ..... 248/447.2
4,957,261 A * 9/1990 Cirami ..... 248/454
5,080,315 A * 1/1992 Tucker-Schafer ..... 248/441.1
5,161,766 A * 11/1992 Arima ..... 248/447
5,451,025 A * 9/1995 Hames ..... 248/456
6,764,055 B1 * 7/2004 Lee ..... 248/451

FOREIGN PATENT DOCUMENTS

JP 48-26641 11/1974
JP 59-157055 5/1986
JP 60-024980 9/1986
JP 62-066699 11/1988
JP 3-031070 10/1992

* cited by examiner

*Primary Examiner*—Korie Chan
(74) *Attorney, Agent, or Firm*—Stetina Brunda Garred & Brucker

(57) ABSTRACT

An article support comprises a supporting plate provided with a resinous slide stopper on a face for supporting an article, and a holding plate, a hinge, a hook bar and an engagement groove as a holding means for maintaining the supporting plates in a predetermined position, thereby facilitating fitting and removal of the article, and expanding an range of application for the article of various kinds.

14 Claims, 17 Drawing Sheets

ARTICLE SUPPORT

TECHNICAL FIELD

The present invention relates to an article support and more particularly to an improved article support suitable to be used as a display stand for articles of commerce and so, or as a supporting base for sheets, small articles and the like.

BACKGROUND

Recently, as a product possible to make propaganda and advertisement of articles of commerce and service in a restricted space, "POP (point of purchase) products" has been variously developed for making the articles of commerce and the like prominent and for exciting consumers' interest to purchase. In the POP products, there has been provided products so designed as to paste the articles on a board or to clamp the articles with clips, as an article support to exhibit, for example, the articles of commerce for POP.

However, in the aforementioned conventional article support for POP, visitors can not observe the articles with care by taking them in their hand, and the board is stained with adhesives or so during the application in the case of pasting the articles on the board. Furthermore, there is inconvenience of limitation in the articles to be exhibited according to the structure of the clips in the case of clamping the articles with the clips.

DISCLOSURE OF THE INVENTION

The present invention has been made in view of the above-mentioned state of the prior art, and it is an object to provide an article support which is possible to attach and remove articles very easily without fixing means such as adhesives, clips or so, and possible to expand an application range for the various kinds of articles.

The article support according to the present invention is characterized by comprising a supporting plate with a face to support an article, and a holding means for maintaining the supporting plates in a predetermined position, the supporting plate is provided with a resinous slide stopper on the face for supporting the article.

In the aforementioned construction, various materials may be applied, such as resin, metal and so on, and it is possible to adopt various colors (including a transparent plane color) and shapes. Although acrylic thermoelastic elastomers, for example, may be used for the slide stopper, it is also possible properly to use the other resins. One or more slide stoppers may be provided on a part or the whole on the supporting face for the article in the supporting plate, and they are preferable to be made in dot-like, linear or suitable flat shapes and disposed systematically on the supporting face of the supporting plate in a case of providing the stoppers on a part of the supporting face. The slide stoppers may be formed in a united one body on the supporting plate successively to forming of the supporting plate, such as double shot molding process as described later, or formed on the previously formed supporting plate as after-processing, furthermore it is also possible to adhere the slide stoppers formed in a separate process to the supporting plate by means of heating, adhesion or the like. It is possible to introduce various constructions into the holding means, which includes not only a means for standing this article support on a base plane in itself, but also a means provided with a device for fixing the support to the other structures.

The article support according to the present invention is characterized in that the holding means maintains the supporting plate at a desired angle variably.

Further, the article support according to the present invention is characterized in that the holding means is equipped with a second supporting plate provided with a slide stopper on a face to support an article.

Furthermore, the article support according to the present invention is characterized in that the supporting plate is provided with a resinous slide stopper at least on a lower end face in an inclined state thereof.

Additionally, the article support according to the present invention is characterized in that the slide stopper is formed in united one body together with a resinous supporting plate through double shot molding process.

In the article support according to the present invention, the supporting plate is maintained in the predetermined position, such as an inclined state or so by the holding means, and the article is attached on this supporting plate. The supporting plate is provided with the resinous slide stopper, therefore the article is maintained in an attached state according to frictional force caused by the slide stopper.

BEST MODE FOR CARRYING OUT THE INVENTION

Figure 1:
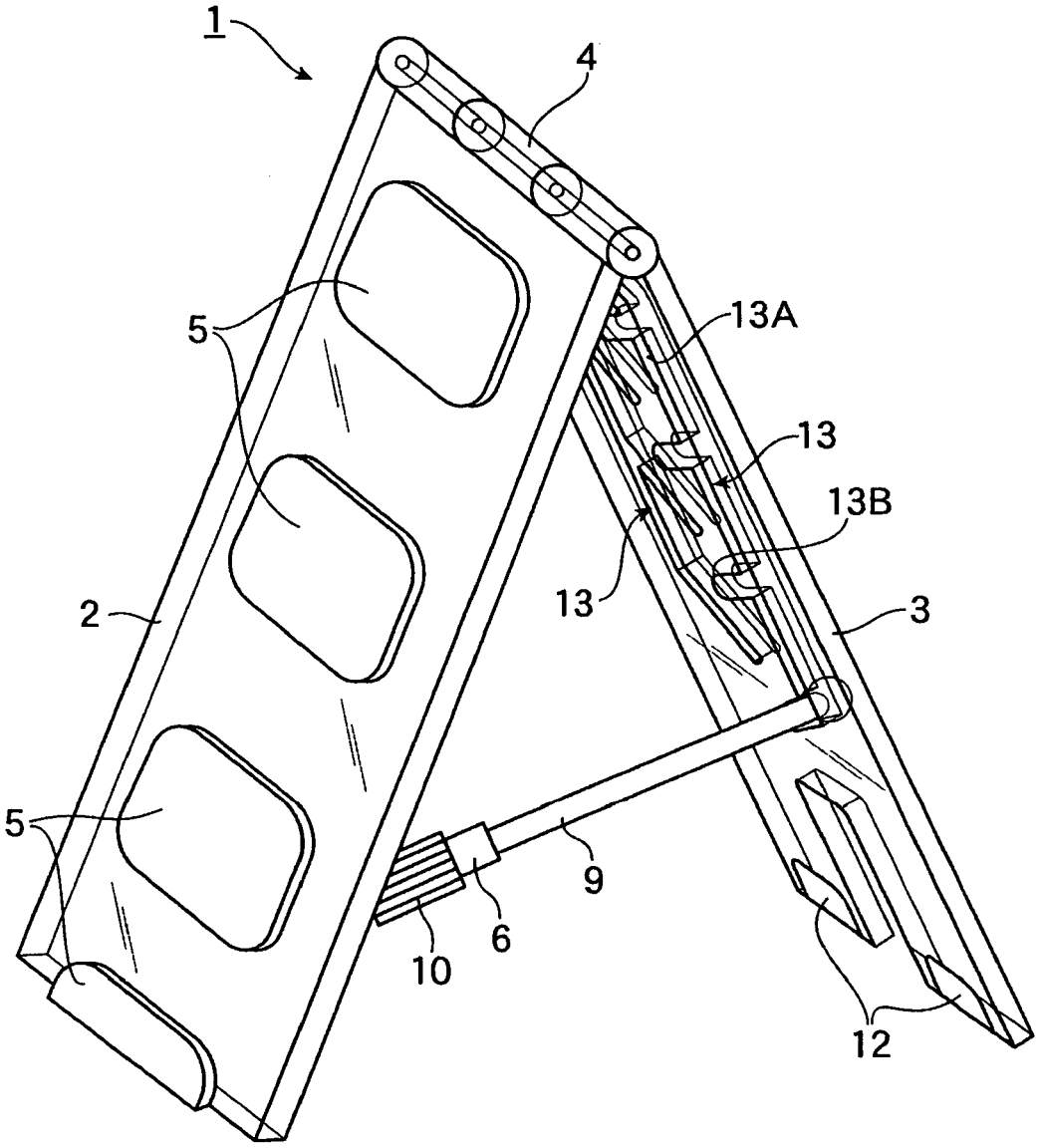
FIG. 1 is a perspective view illustrating the first example of the article support according to this invention.
Figure 2:
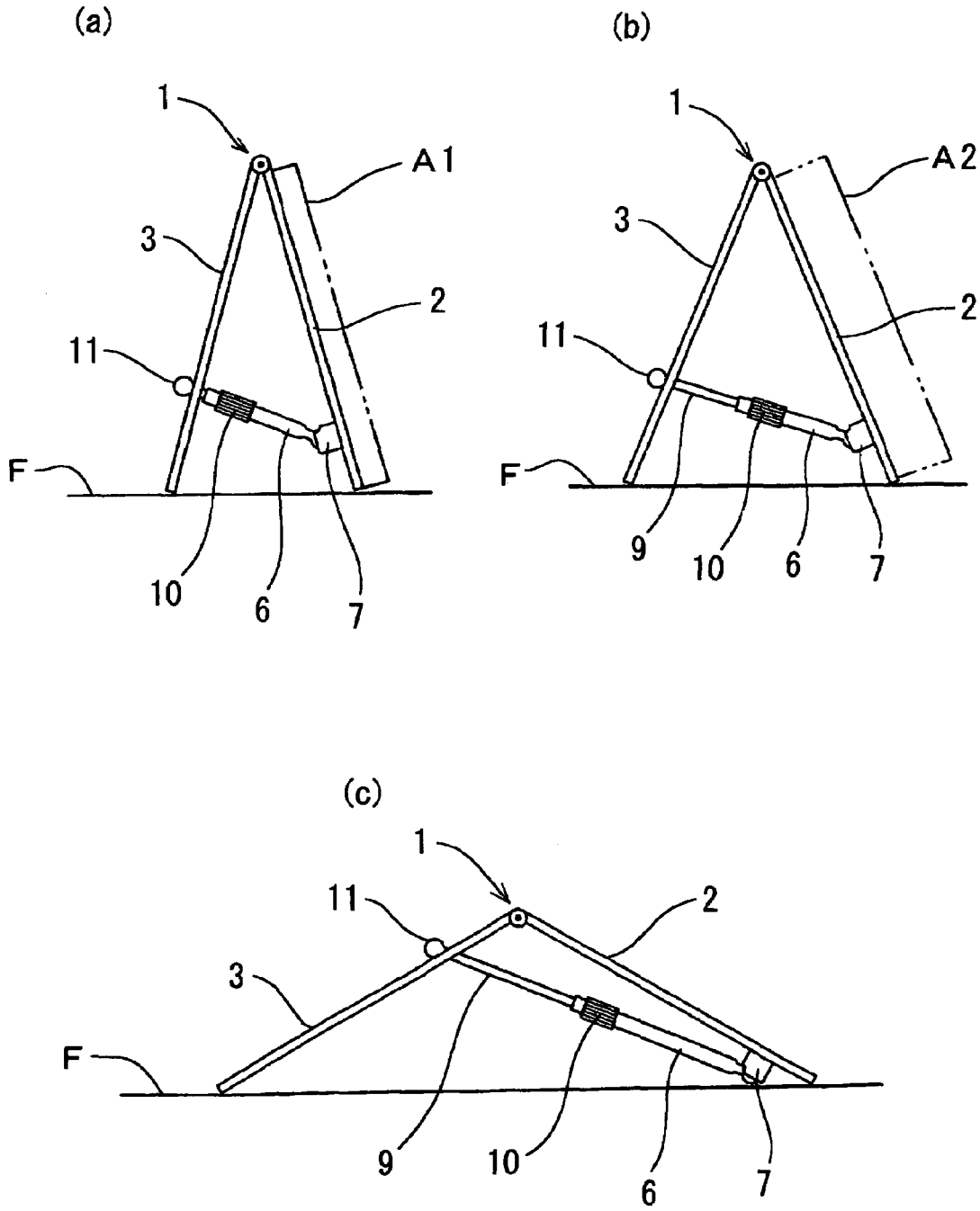
FIGS. 2(*a*) to (*c*) are side elevations explaining application of the article support shown in FIG. 1.
Figure 3:
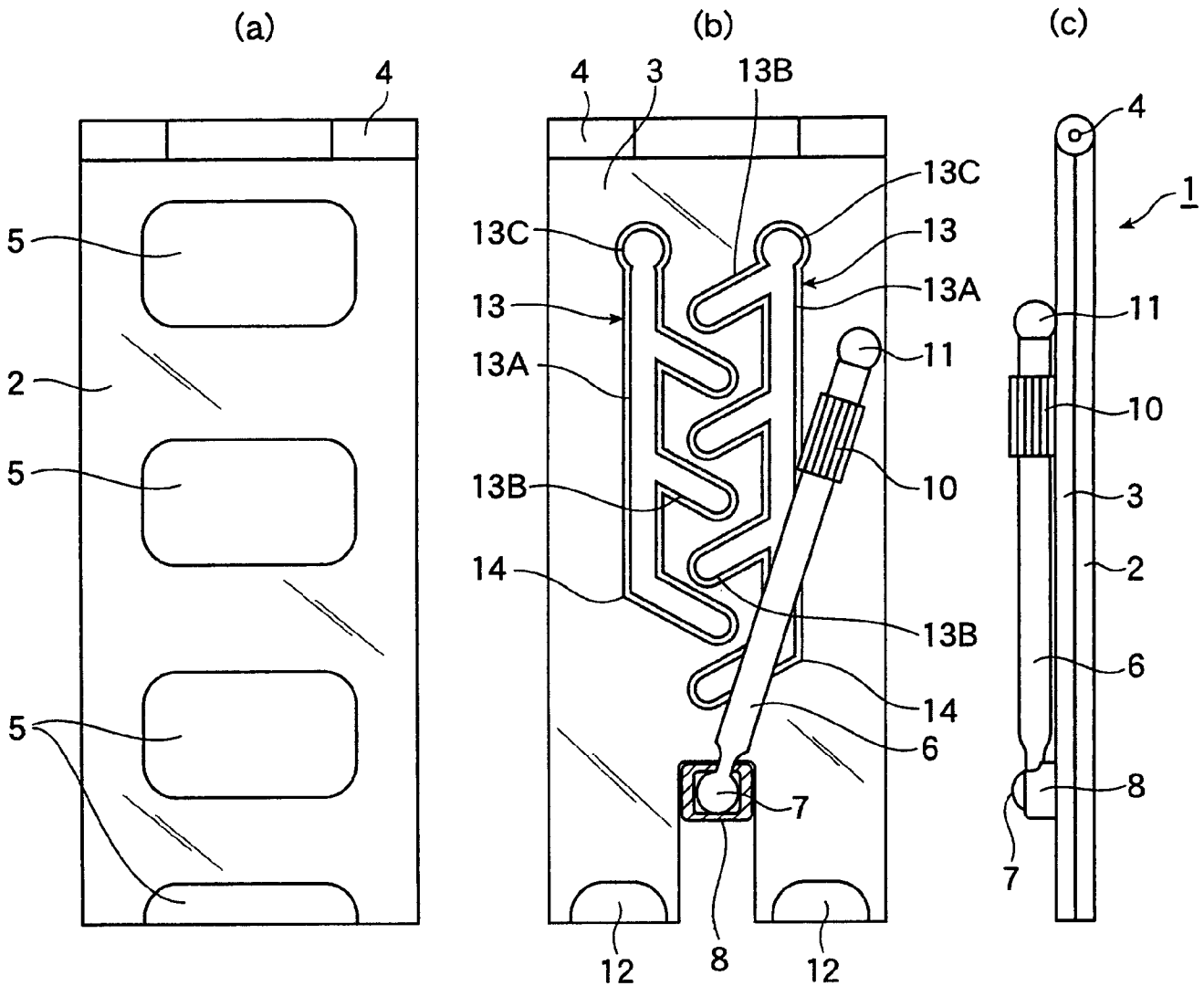
FIGS. 3 are a front elevation (a), a rear elevation (b), and side elevation (c) of the article support shown in FIG. 1.

FIG. 1 to FIG. 3 are drawings for explaining the first example of the article support according to this invention. An article support 1 shown in FIG. 1 is provided with a rectangular supporting plate 2 and a holding plate 3 in size about equal to the supporting plate 2. The supporting plate 2 and the holding plate 3 are connected rotatably with each other at shorter sides on the upper side through a hinge 4 in a state of placing longer sides of the plates 2 and 3 vertically.

The supporting plate 2 is made of transparent resin, and resinous slide stoppers 5 are formed monolithically (in one body) on the front surface to support the article process as also shown in FIG. 3 through double forming. The material of the slide stoppers 5 are properly selected in consideration of affinity or so for the material of the supporting plate 2, acrylic thermoelastic elastomer is used, for example.

In this example, the slide stoppers 5 formed in almost rectangular sheet-like shapes are disposed at tree places on the front surface of the supporting plate at equal intervals in the vertical direction and, further disposed on the part ranging to the lower end face from the front surface of the supporting plate. Although illustration is abbreviated, it is possible to improve the antislipping function by forming very small roughness on the surface of the slide stoppers 5.

Further, the supporting plate 2 is connected with one end of a hook bar 6 at the lower part on the reverse face thereof. In this connection, a ball joint is used, which is composed of a connecting ball 7 provided at the one end of the hook bar 6 and a ball-retainer 8 forming a spherical pair together with the connecting ball 7 on the side of supporting plate 2. The hook bar 6 is inserted with an adjusting bar 9 slidably from another end side thereof, and provided with a rock screw 10 for fixing the adjusting bar 9 at the desired siding position according to its tightening operation. Further, the adjusting bar 9 is provided with an engaging ball 11 for the holding plate 3 at a free end thereof.

The holding plate 3 is made of resin similarly to the supporting plate 2, and provided with slide stoppers 12 at the lower end and two engaging grooves 13 opening on front and reverse sides thereof. The engaging groove 13 has a width smaller than the diameter of the engaging ball 11 of the adjusting bar 9, provided with a linear part 13A formed in a longitudinal direction of the holding plate 3 and plural branches 13B formed in diagonal-downward direction from the linear part 13A, and further formed with a ball-inserting part 13C to insert the engaging ball 11 at the upper end thereof. The branches 13B are used selectively for positioning the hook bar 6 and formed at predetermined intervals in the vertical direction. Furthermore, the engaging groove 13 is formed with a slide stopper 14 along an edge thereof.

In the aforementioned article support 1, the holding means, which maintains the supporting plate 2 in a predetermined position and maintains the supporting plate 2 at various angles according to demand, is composed mainly by the holding plate3, the hinge 4, the hook bar 6 and the engaging grooves 13.

The article support 1 can be stored compactly by making the hook bar 6 parallel to the supporting plate 2 and putting the holding plate 3 on the front surface (surface on which the slide stoppers 5 are provided) of the supporting plate 2, as shown in FIG. 3(*c*).

In a case of using the article support 1, the holding plate 3 is swung toward the reverse side of the supporting plate 2 around the hinge 4 from the state shown in FIG. 3(*c*), the engaging ball 11 of the hook bar 6 is passed through the ball-inserting part 13C of the engaging groove 13, and the hook bar 6 is moved into the linear part 13A of the groove 13 and positioned in properly selected one of the branches 13B. Accordingly, the relative movement between supporting plate 2 and holding plate 3 is restrained in a state where these plates form a certain angle, thereby enabling the article support 1 to stand on a plane F to be placed as shown in FIG. 2(*a*).

In this state, an article A1 is set on the inclined supporting plate 2. In this article support 1, the supporting plate 2 is formed with the resinous slide stoppers 5, therefore the setting state of the article A1 is maintained with frictional force caused by the slide stoppers 5 and it is very easy to remove the article A1. Additionally, since the resinous slide stoppers 5 and 12 are also provided at the lower ends of the supporting plate 2 and the holding plate 3, it is possible to stand the support 1 more stably and possible to prevent the setting plane F from damage.

In a case of applying the aforementioned article support 1 to a display stand for POP, it becomes possible to put commodities (articles of commerce) or the like on display in positions convenient to be ascertained without using fixing means such as clips, adhesives or so by setting them on the supporting plate 2 maintained in a inclined state, accordingly it is easy to observe the commodities or the like by taking them by hands, it is possible to exhibit the whole aspect of the commodities or the like and possible to cope with the commodities or the like of various size and shapes. Further, because the supporting plate 2 is transparent, the under side of the article support 1 does not become dark nor invisible even if the support 1 is placed on commodities or a showcase.

Furthermore, an angle of inclination of the supporting plate 2 in the article support 1 is adjustable in accordance with weight, size and so of the articles A1 and A2 as shown in FIGS. 2(*a*) and 2(*b*). In this case, it is possible to change the angle between supporting plate 2 and holding plate 3, that is the angle of inclination of the supporting plate 2 by selecting the engaging position (branch 13B) of the engaging ball 11 against the engaging groove 13 as shown in FIGS. 2(*a*) and 2(*b*), and possible to change the angle of inclination of the supporting plate 2 without changing the engaging position between engaging ball 11 and engaging groove 13 by changing the total length of the hook bar 6 according to adjustment of a stick-out position of the adjusting bar 9, furthermore the angle between supporting plate 2 and holding plate 3 becomes maximum by engaging the hook bar 6 made into maximum length to the highest branch 13B as shown in FIG. 2(*c*), whereby it is possible to make the inclination of the supporting plate 2 most gently.

Figure 4:
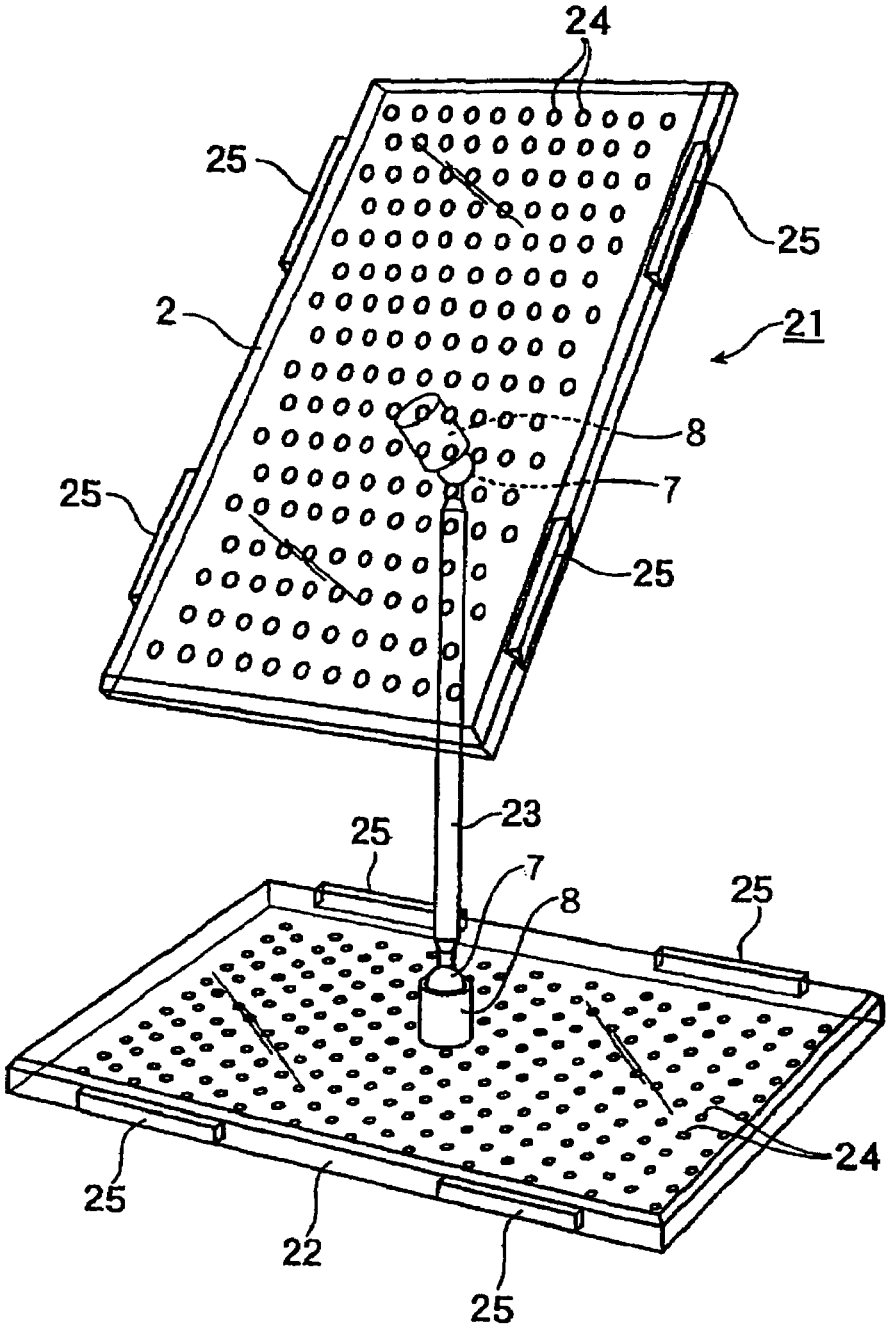
FIG. 4 is a perspective view illustrating the second example of the article support according to this invention.
Figure 5:
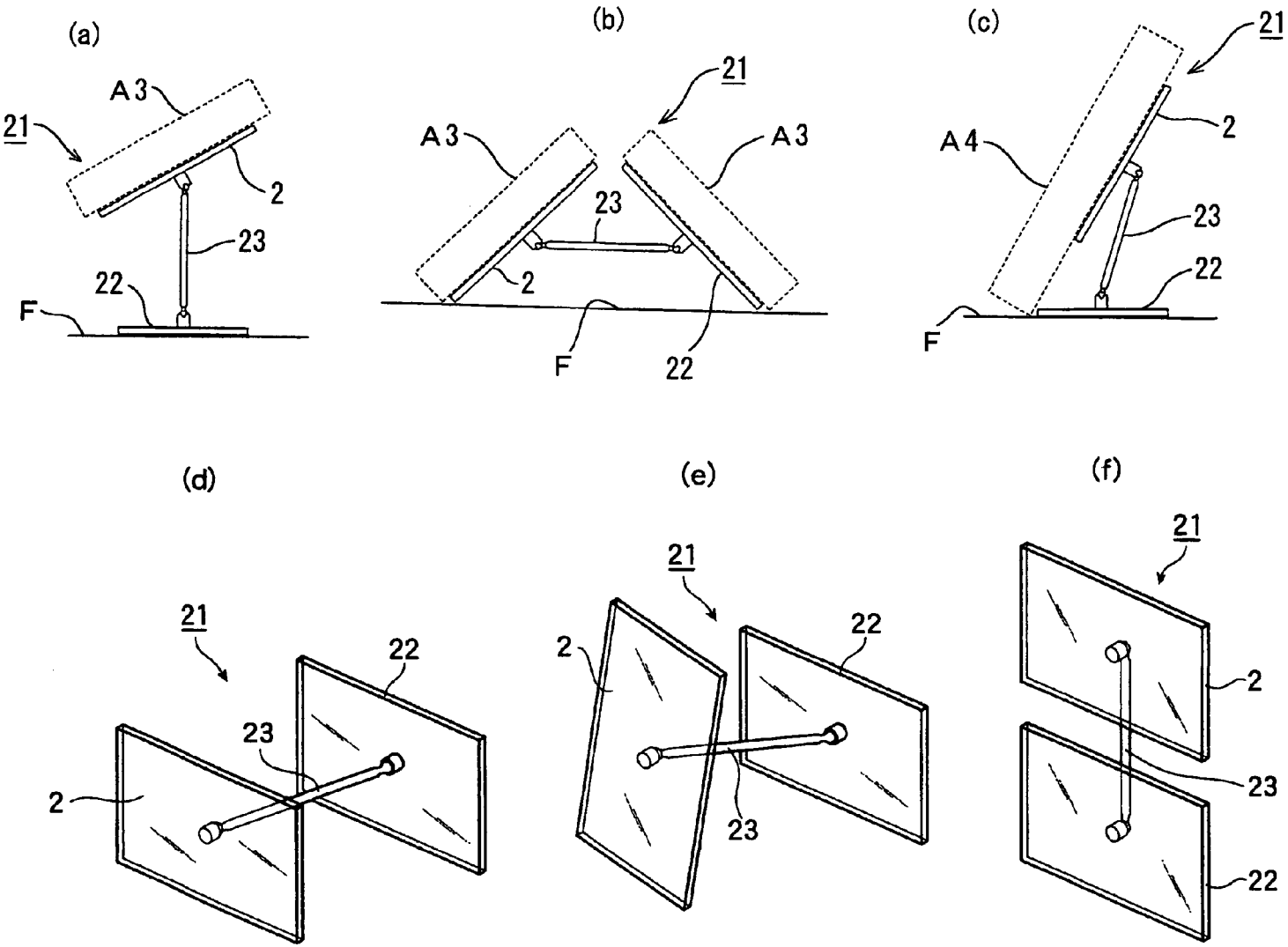
FIG. 5 are side elevations (a) to (c), perspective views explaining application states (d) and (e) and a storage state (f) of the article support shown in FIG. 2.

FIG. 4 and FIG. 5 are drawings for explaining the second example of the article support according to this invention. In this case, the detailed explanation is simplified by giving the same symbol mark against the same part as the previous example.

An article support 21 shown in FIG. 4 is provided with a supporting plate 2 and a second supporting plate 22 formed in size about equal to the supporting plate 2. The supporting plates 2 and 22 are equipped with ball-retainers 8, 8 at the center on each of the reverse faces thereof, and the plates 2 and 22 are connected with each other through a connecting bar 23 provided with connecting balls 7, which forms ball joints together with the respective ball-retainers 8, at the both ends thereof. Accordingly, the both supporting plates 2 and 22 are rotatable around three axes perpendicularly intersecting each other.

In this example, the ball-retainer 8 and the connecting ball 7 are respectively in spherical contact with each other under the predetermined frictional force, and the plates 2 and 22 are possible to be rotated around the axes by loading force exceeding the above-mentioned frictional force and possible to maintain the desired positions according to the frictional force.

The supporting plates 2 and 22 are respectively formed with a large number of resinous slide stoppers 24 formed in nearly semispherical shapes and arranged, and further formed with resinous slide stoppers 25 on also end faces thereof. These slide stoppers 24 and 25 may be formed monolithically through the double shot molding process.

In the aforementioned article support 21, the holding means is composed mainly by the second supporting plate 22 and the connecting bar 23 for maintaining the supporting plate 2 in the predetermined position and maintaining the supporting plate 2 at various angles desirably.

The article support 21 is made into a standing state by placing the second supporting plate 22 so as to be in contact with the setting plane F and regulating the angle between second supporting plate 22 and connecting bar 23, and the angle between connecting bar 23 and supporting plate 2 as also shown in FIG. 5(*a*), thereby supporting an article A3 on the inclined supporting plate 2. In this article support 21, the more stable standing state can be obtained without damaging the setting plane F since the resinous slide stoppers 24 are provided also on the surface of the second supporting plate 22. Additionally, although the supporting plate 2 out of contact with the setting plane F is shown in FIG. 5(*a*), it is naturally possible to stand the article support 21 in a state where the lower end of the supporting plate 2 is in contact with the setting plane F.

Further, it is possible to support the articles 3A, 3A on the respective supporting plates 2 and 22 by inclining the both plates 2 and 22 on the opposite directions with each other as shown in FIG. 5(*b*). Additionally, in the standing state of making the second supporting plate 22 in contact with the setting plane F and separating the supporting plate 2 from the setting plane F, it is possible to support an article A4 clearly larger than the supporting plate 2 between supporting plate 2 and setting plane F as shown in FIG. 5(*c*).

Furthermore, each of the supporting plates 2 and 22 is possible to be rotated also in a direction parallel to respective surfaces thereof, therefore it is possible to make the article support 21 into a state where the relative directions of the longer sides of the rectangular plates 2 and 22 agree with each other or a state where the relative directions of the longer sides intersect each other as shown in FIGS. 5(*d*) and 5(*e*), and it is convenient to store the article support 21 by putting each of surfaces of the plates 2 and 22 together in one plane as shown in FIG. 5(*f*).

Moreover, in the article support 21, it is also possible to maintain the supporting plates 2 horizontally in a case of placing the second supporting plate 22 so as to be in contact with the setting plane F, therefore it may be used as a table for placing small articles such as glasses, a wrist watch and so on, so that the application range for various kinds of articles is expanded.

Figure 6:
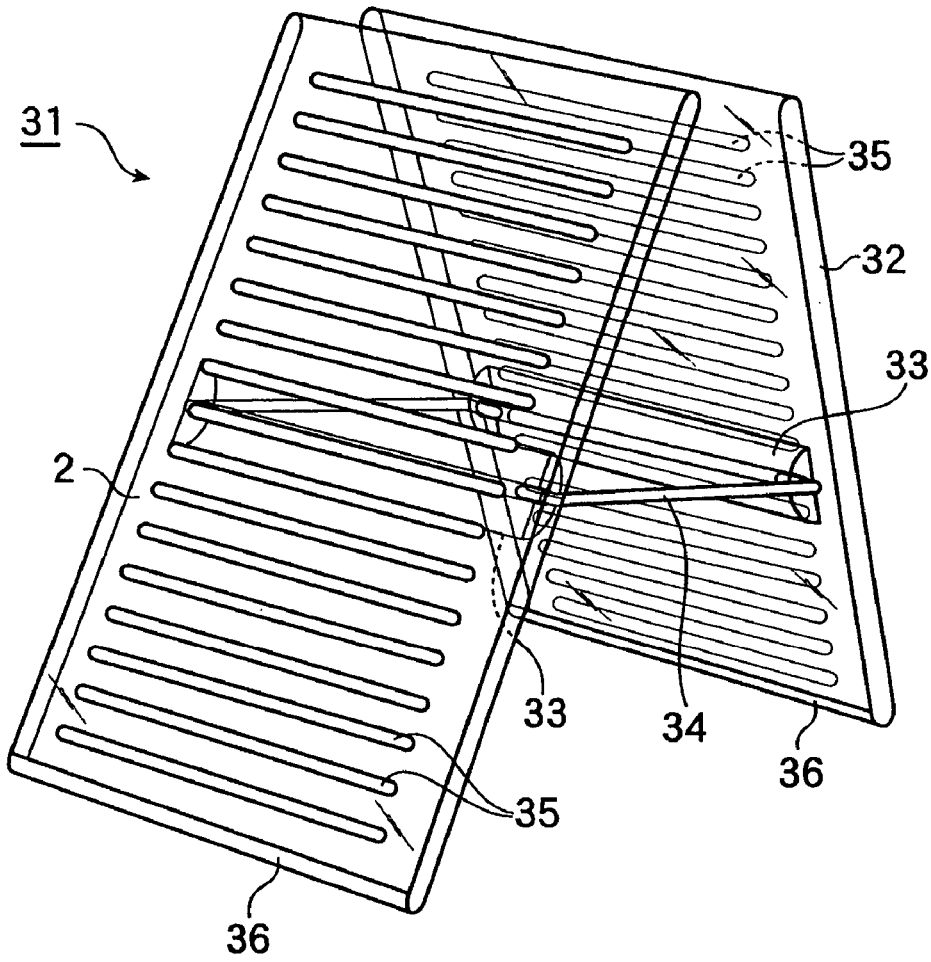
FIG. 6 is a perspective view illustrating the third example of the article support according to this invention.
Figure 7:
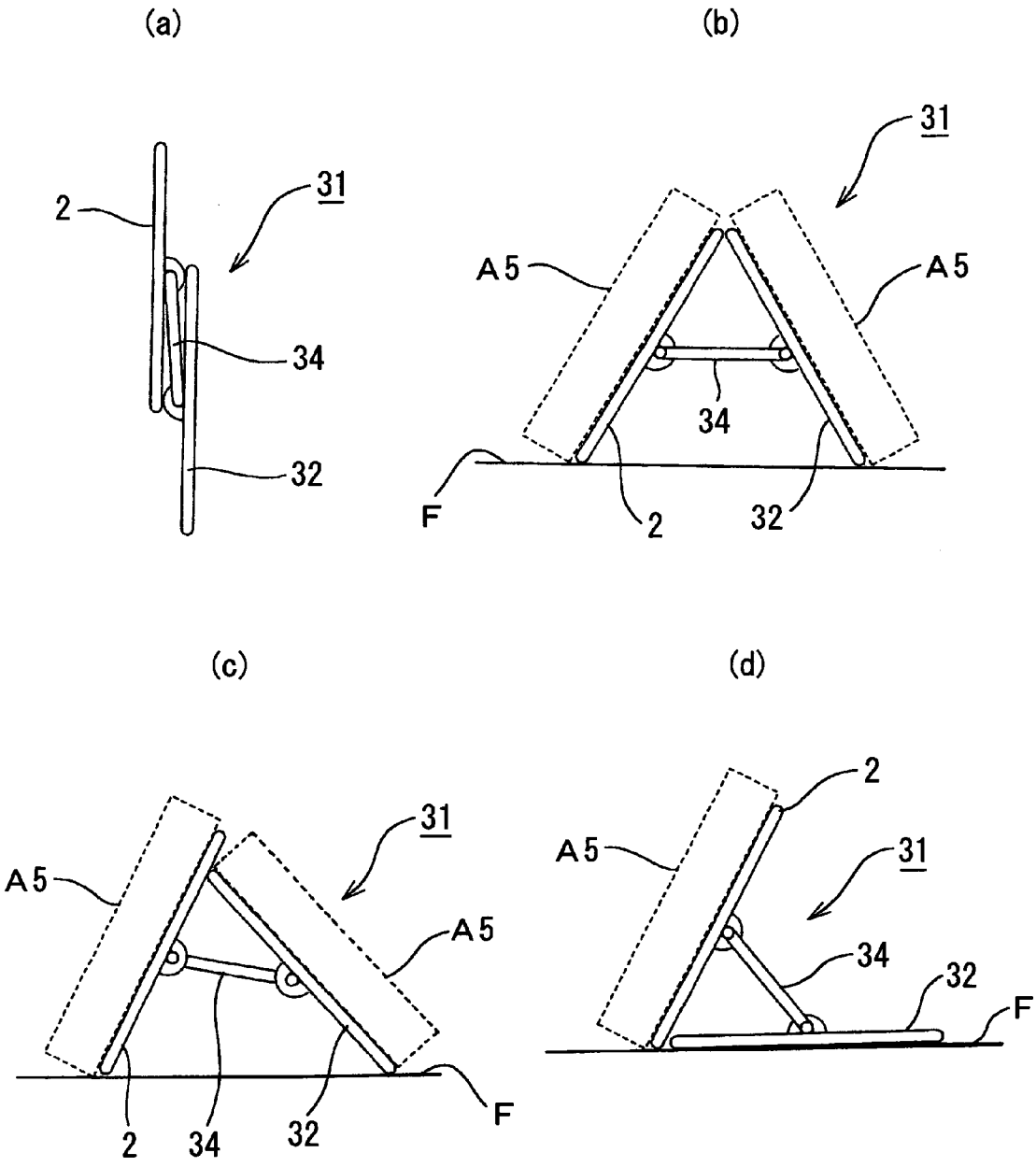
FIG. 7 are side elevations explaining a storage state (a), and application states (b) to (d) of the article support shown in FIG. 6.

FIG. 6 and FIG. 7 are drawings for explaining the third example of the article support according to this invention.

An article support 31 shown in FIG. 6 is provided with a supporting plate 32 formed in size about equal to the supporting plate 2. The supporting plates 2 and 32 are equipped with cylindrical parts 33 parallel to the shorter sides in united one body at the center on each of the reverse faces thereof, and connected with each other through a pair of connecting arms 34 of which both ends are rotabably engaged with round inner holes of the respective cylindrical parts 33.

In this example, the inner holes of the cylindrical parts 33 and the connecting arms 34 are in contact with each other under predetermined frictional force, and the connecting arms 34 can be rotated by loading force exceeding the above-mentioned frictional force and possible to maintain the desired positions according to the frictional force.

The respective supporting plates 2 and 22 are formed with resinous slide stoppers 35 having linear shapes at the predetermined intervals along the shorter sides thereof, and further formed with resinous slide stoppers 36 also on the end faces of the shorter sides thereof.

In the aforementioned article support 31, the holding means is composed mainly by the second supporting plate 32 and the connecting arms 34 for maintaining the supporting plate 2 in the predetermined position and maintaining the supporting plate 2 at various angles according to demand.

The article support 31 can be stored compactly by folding so as to bring the reverse faces of the both supporting plates 2 and 32 close with each other as shown in FIG. 7(*a*), and possible to support two articles A5, A5 by inclining the both plates 2 and 22 on the opposite directions with each other as shown in FIG. 7(*b*).

By putting the upper end of the second supporting plate 32 to be in contact with the reverse face of the supporting plate 2 as shown in FIG. 7(*c*), it is possible to support two articles A5, A5 and the second supporting plate 32 works as a support of the supporting plate 2, furthermore by placing the second plate 32 so as to be in contact with the setting plane F, it is possible to maintain the supporting plate 2 in the inclined state as shown in FIG. 7(*d*), and also possible to maintain the supporting plate 2 in the horizontal state in this case.

Figure 8:
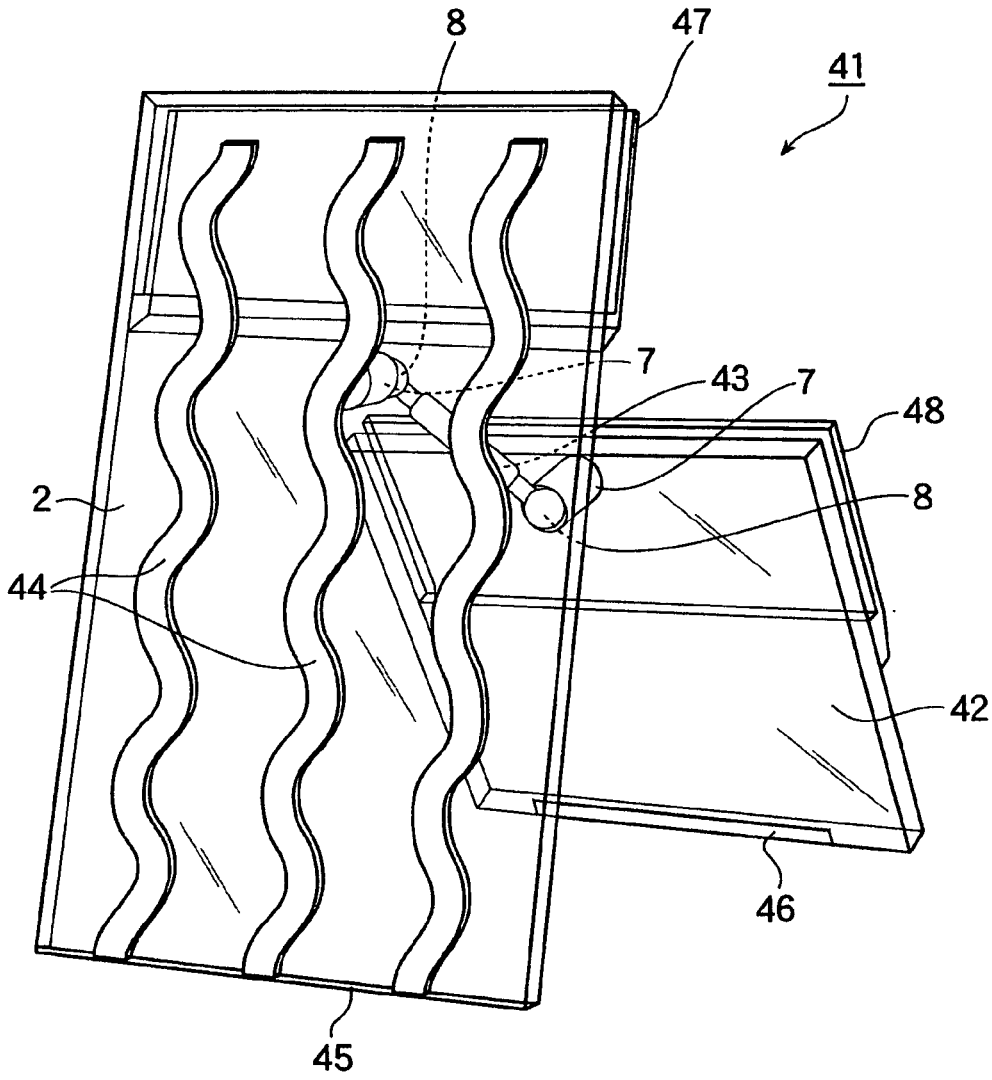
FIG. 8 is a perspective view illustrating the fourth example of the article support according to this invention.
Figure 9:
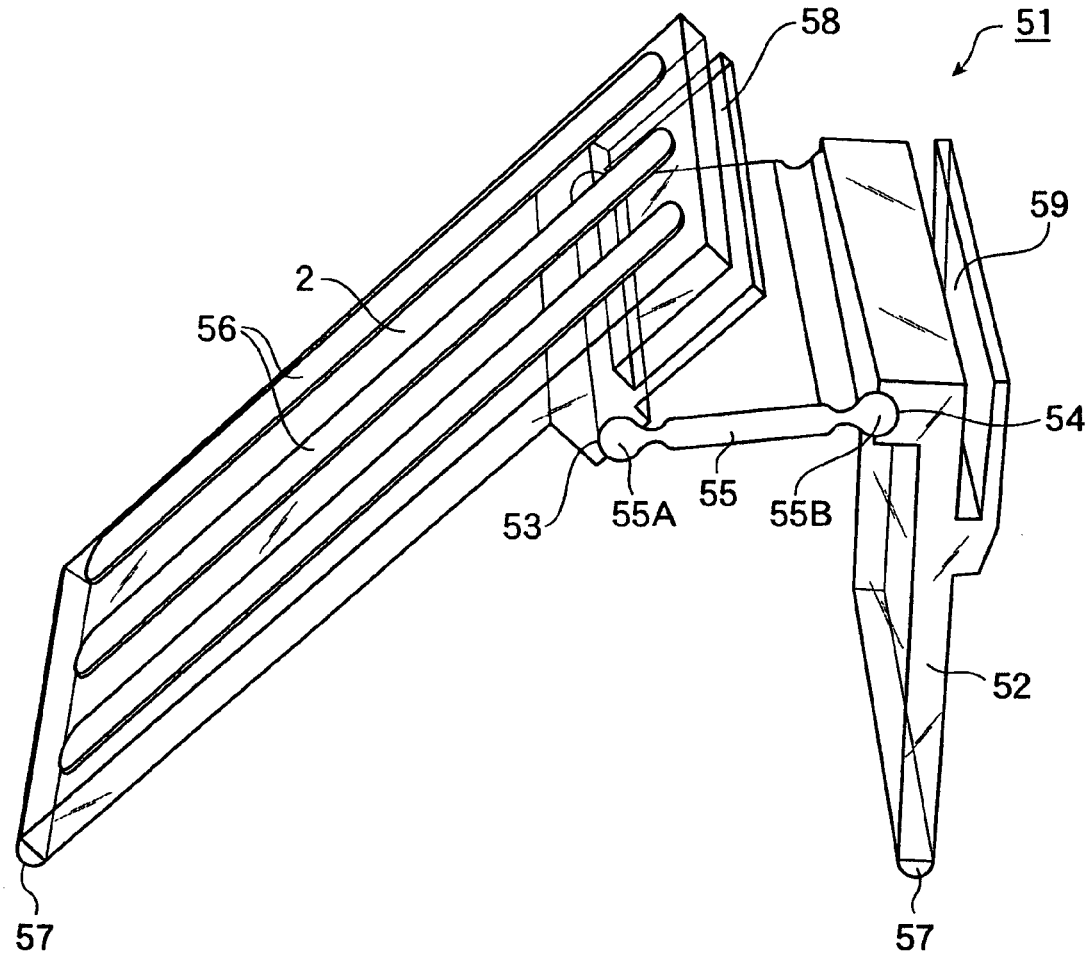
FIG. 9 is a perspective view illustrating the fifth example of the article support according to this invention.
Figure 10:
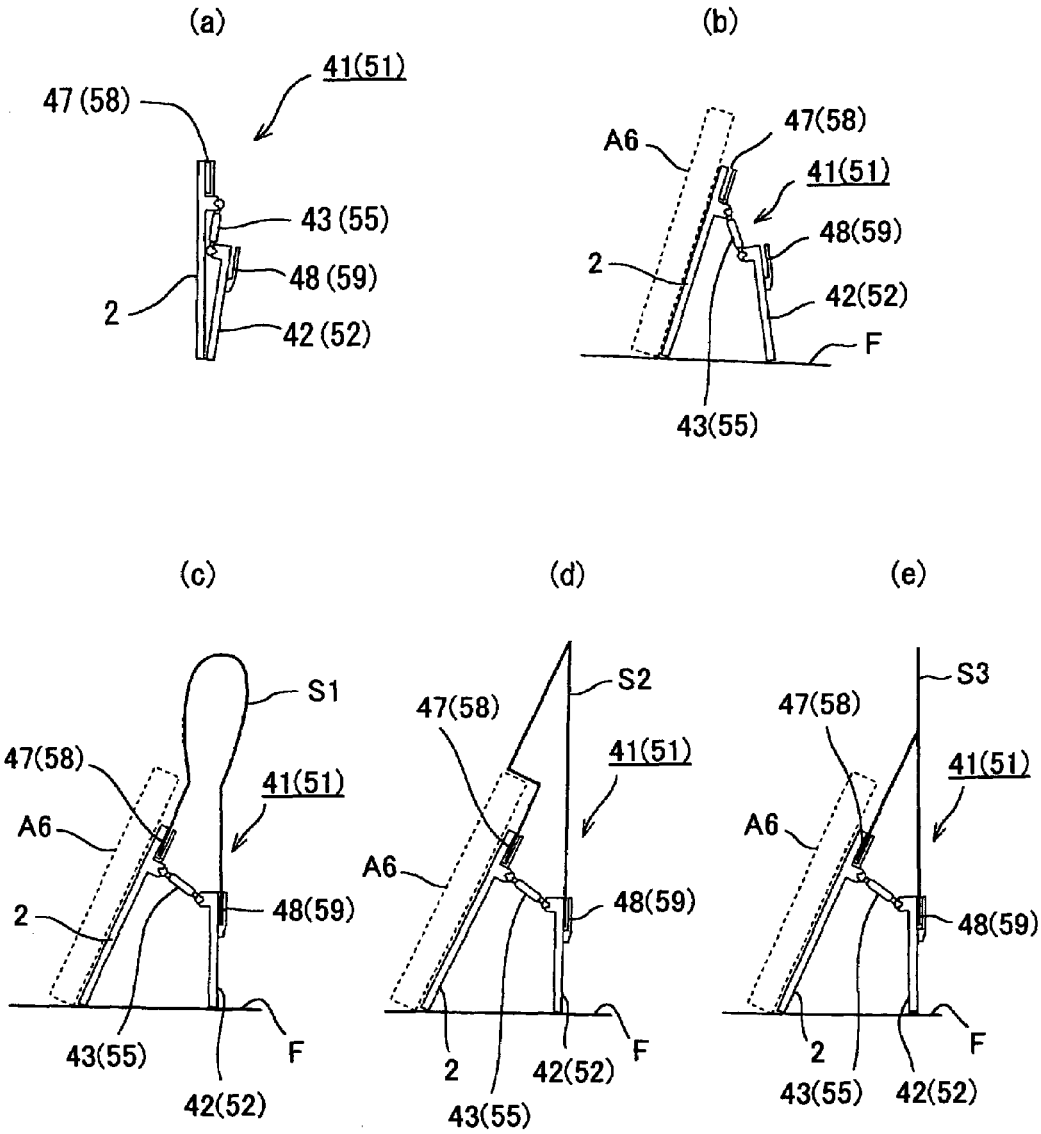
FIG. 10 are side elevations explaining a storage state (a), and application states (b) to (e) of the article supports shown in FIGS. 8 and 9.
Figure 11:
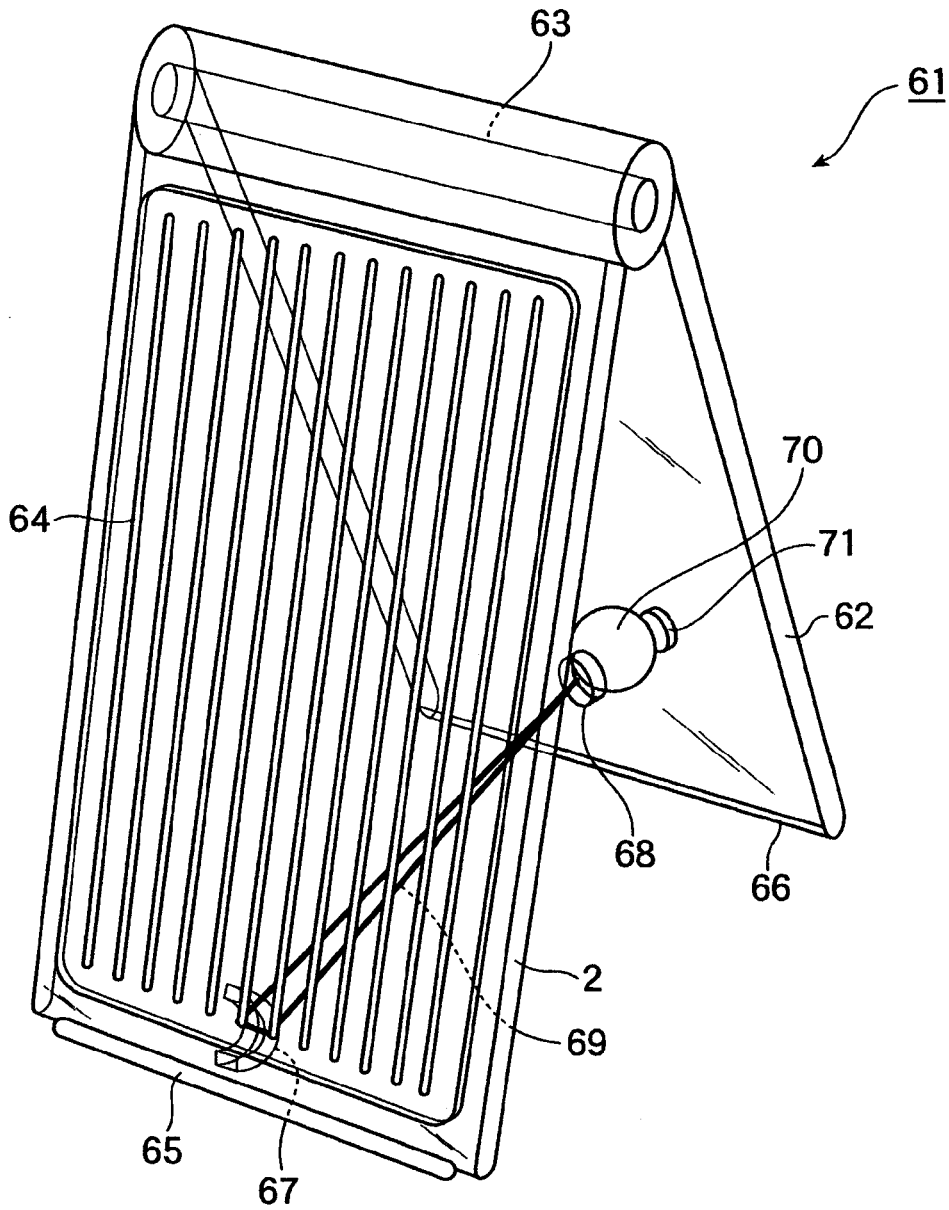
FIG. 11 is a perspective view illustrating the sixth example of the article support according to this invention.
Figure 12:
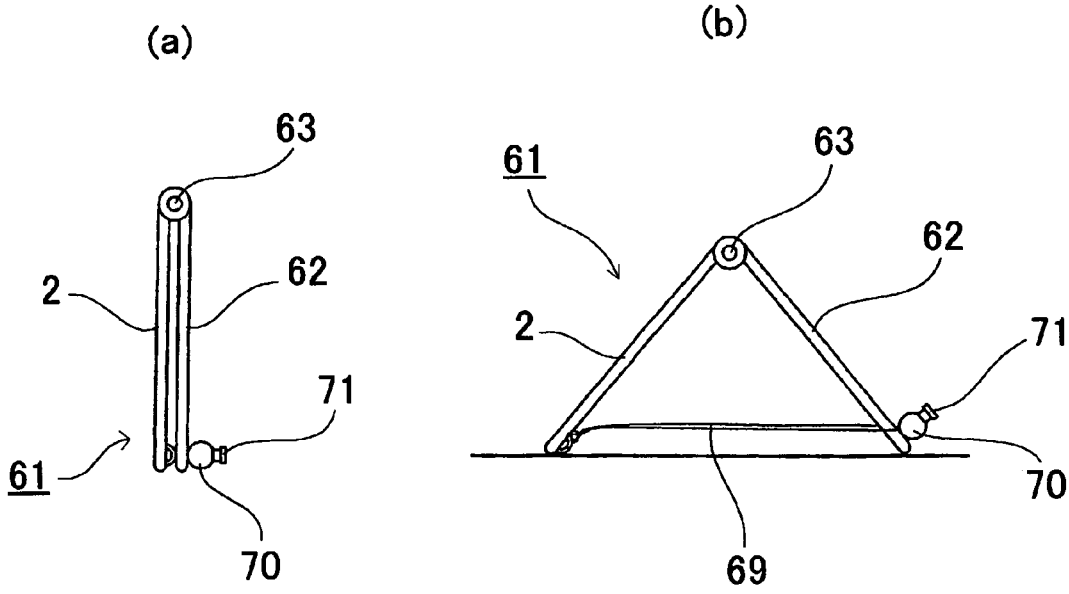
FIG. 12 are side elevations explaining a storage state (a), and application states (b) of the article supports shown in FIG. 11.
Figure 13:
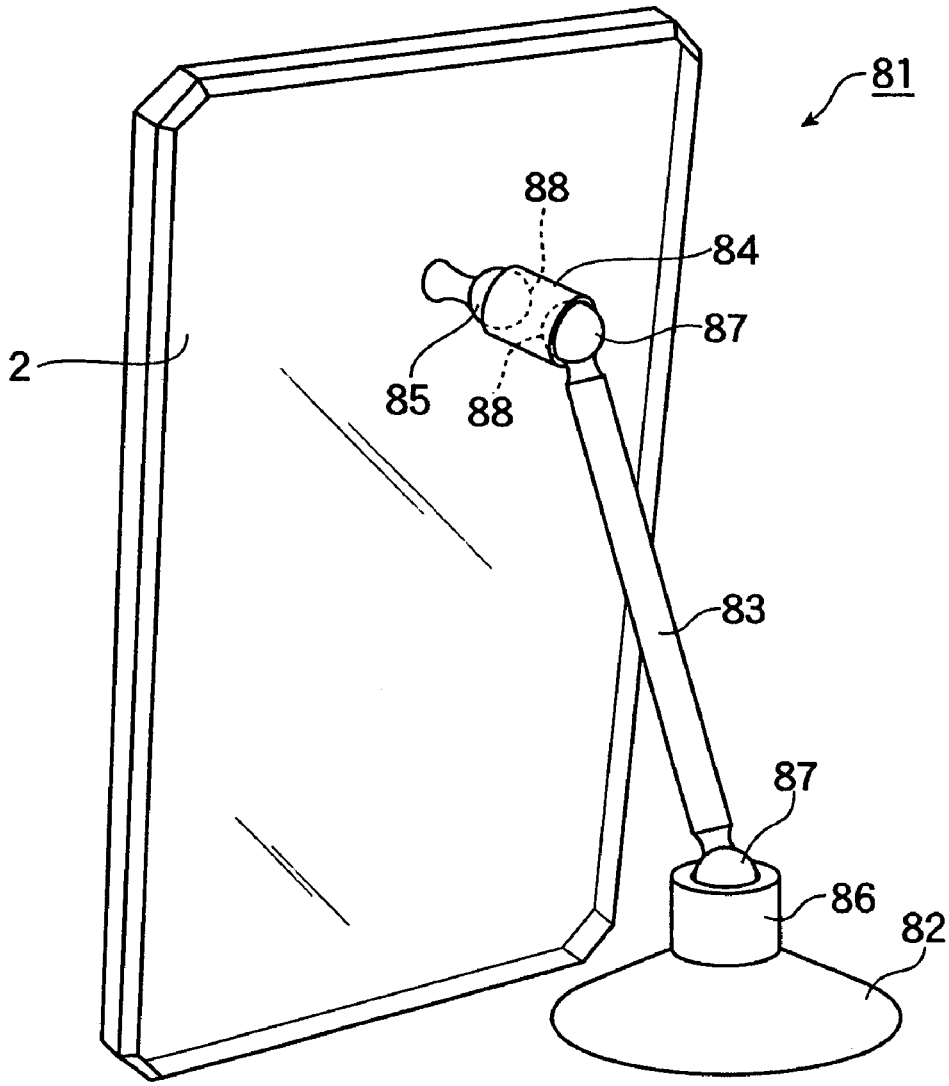
FIG. 13 is a perspective view illustrating the seventh example of the article support according to this invention.
Figure 14:
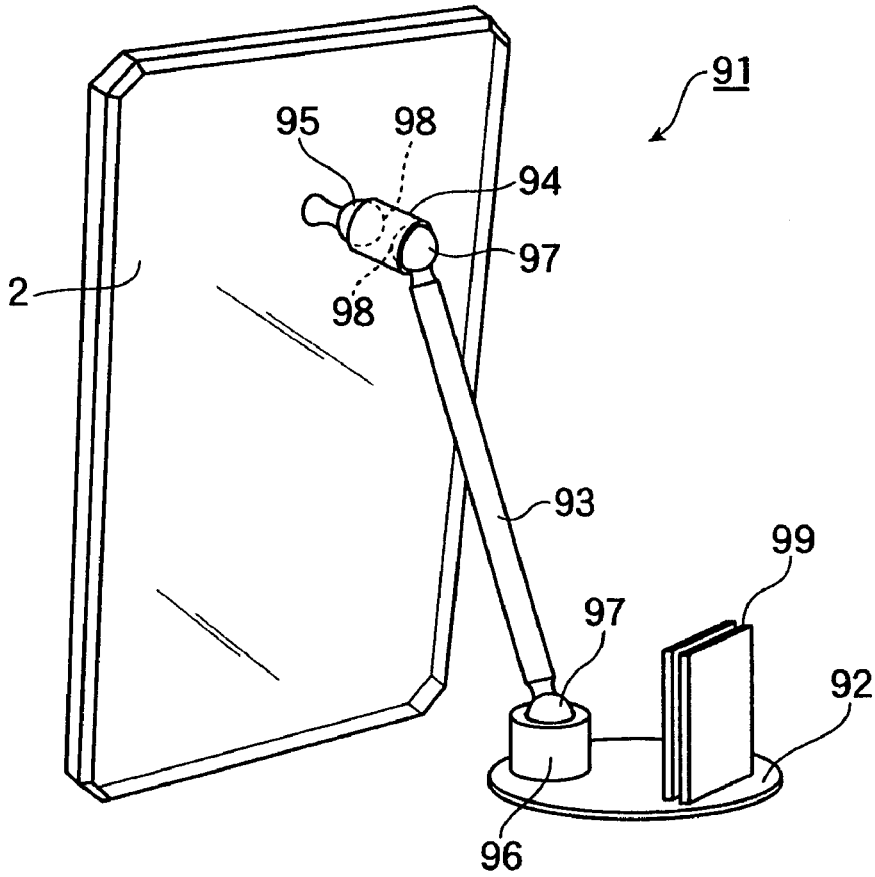
FIG. 14 is a perspective view illustrating the eighth example of the article support according to this invention.

FIG. 8 and FIG. 9 are drawings for explaining the fourth and fifth examples of the article support according to this invention.

An article support 41 shown in FIG. 8 is provided with a supporting plate 2 and a holding plate 42, and the both plates 2 and 42 are connected rotatably through respective ball-retainers 7, 7 and a connecting bar 43 having connecting balls 8, 8 at the both ends thereof. In this example, the ball-retainer 7 and the connecting ball 8 form the ball joint similarly to the previous example, and are in spherical contact with each other under the predetermined frictional force.

The supporting plate 2 is formed with resinous belt-shaped slide stoppers 44 meandering in the longitudinal direction at the predetermined intervals on the surface thereof. Further, the supporting plate 2 and the holding plate 42 are formed with resinous slide stoppers 45 and 46 monolithically on the respective lower ends thereof, and formed with respective slits 47 and 48 opening on the upper, right and left sides at the upper portions thereof.

An article support 51 shown in FIG. 9 is provided with a supporting plate 2 and a holding plate 52 similarly to the device shown in FIG. 8. The supporting plate 2 and the holding plate 52 have connecting grooves 53 and 54 on the respective opposing faces thereof, and connected rotatably with each other by a connecting plate 55 engaged with the connecting grooves 53 and 54 of the both plates. The connecting grooves 53 and 54 have circular sections, on the other side, the connecting plate 55 is provided with connecting parts 55A, 55B with circular cross sections at both ends thereof, and the connecting grooves 53, 54 and the connecting parts 55A, 55B of the connecting plate 55 are in contact with each other under the predetermined frictional force.

An article support 51 shown in FIG. 9 is provided with a supporting plate 2 and a holding plate 52 similarly to the device shown in FIG. 8. The supporting plate 2 and the holding plate 52 have connecting grooves 53 and 54 on the respective opposing faces thereof, and connected rotatably with each other by a connecting plate 55 engaged with the connecting grooves 53 and 54 of the both plates. The connecting grooves 53 and 54 have circular sections, on the other side, the connecting plate 55 is provided with connecting parts 55A, 55B with circular cross sections at both ends thereof, and the connecting grooves 53, 54 and the connecting parts 55A, 55B of the connecting plate 55 are in contact with each other under the predetermined frictional force.

Further, the supporting plate 2 is formed with linear contacting the holding plate 92 on the setting plane. Further, this article support is suitable as a display stand for POP, and possible to set a board indicated with messages for propaganda or advertisement of the commodities in the board stand 99.

Figure 15:
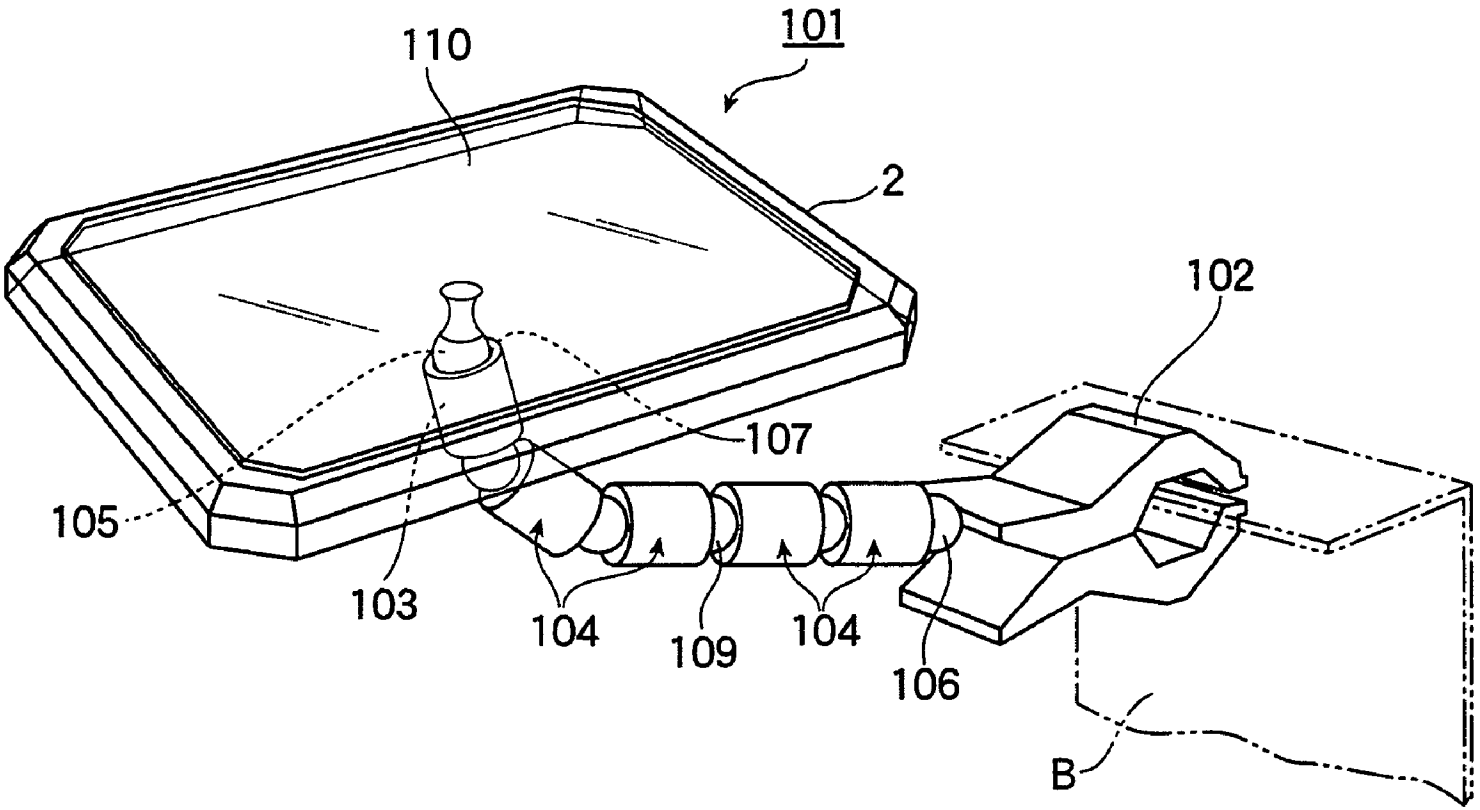
FIG. 15 is a perspective view illustrating the ninth example of the article support according to this invention.

FIG. 15 is a drawing for explaining the ninth example of the article support according to this invention. An article support 101 shown in the drawing is provided with a holding clip 102, a supporting plate 2 and the holding clip 102 are connected through plural connecting pieces 103, 104. The supporting plate 2 is formed with a sheet-like shaped resinous slide stopper 110 on the front surface thereof.

The supporting plate 2 is provided with a connecting ball 105 on the reverse face thereof and a connecting ball 106 is provided to the holding clip 102. There are two kinds of connecting pieces; viz. a first connecting piece 103 having ball-retainers 107, 107 at the both ends and a second connecting piece 104 having a ball-retainer 108 and a connecting ball 109 at the respective ends, and one piece of the first connecting piece 103 and four pieces of the second connecting piece 104 are used in this example. These connecting balls 105, 106 and 109 and ball-retainers 107 and 108 compose the ball joints forming a spherical pair with the predetermined frictional force similarly to the previous examples.

The connecting ball 105 of the supporting plate 2 is fitted rotatably into one of the ball-retainers 107 of the first connecting piece 103, and the four connecting pieces 104 are successively connected to the first connecting piece 103, finally the connecting ball 106 of the holding clip 102 is fitted rotatably into the ball-retainer 108 of the second connecting piece 104 at the tail.

In the aforementioned article support 101, the holding means is composed mainly by the holding clip 102, the first and second connecting pieces 103 and 104 for maintaining the supporting plate 2 in the predetermined position and maintaining the supporting plate 2 at various angles according to demand.

The article support 101 is used by attaching its own body to another structure B with the holding clip 102. Accordingly, the article support 101 can be attached to not only the horizontal part of the structure B as shown in FIG. 15, but also to the inclined position or the vertical position, and possible to improve the degree of freedom in the installation.

Furthermore, the article support 101 is possible to support the article after setting freely the position of the supporting plate 2 without restriction because the holding means forms a articulated body by the plural connecting pieces 103, 104. Furthermore, it is possible to maintain the supporting plate 2 horizontally, and possible to be used as a table for placing the small articles in addition to the display stand for POP, accordingly it is possible to realize further expansion of the application in corporation with the aforementioned improvement of degree of freedom in the installation.

Figure 16:
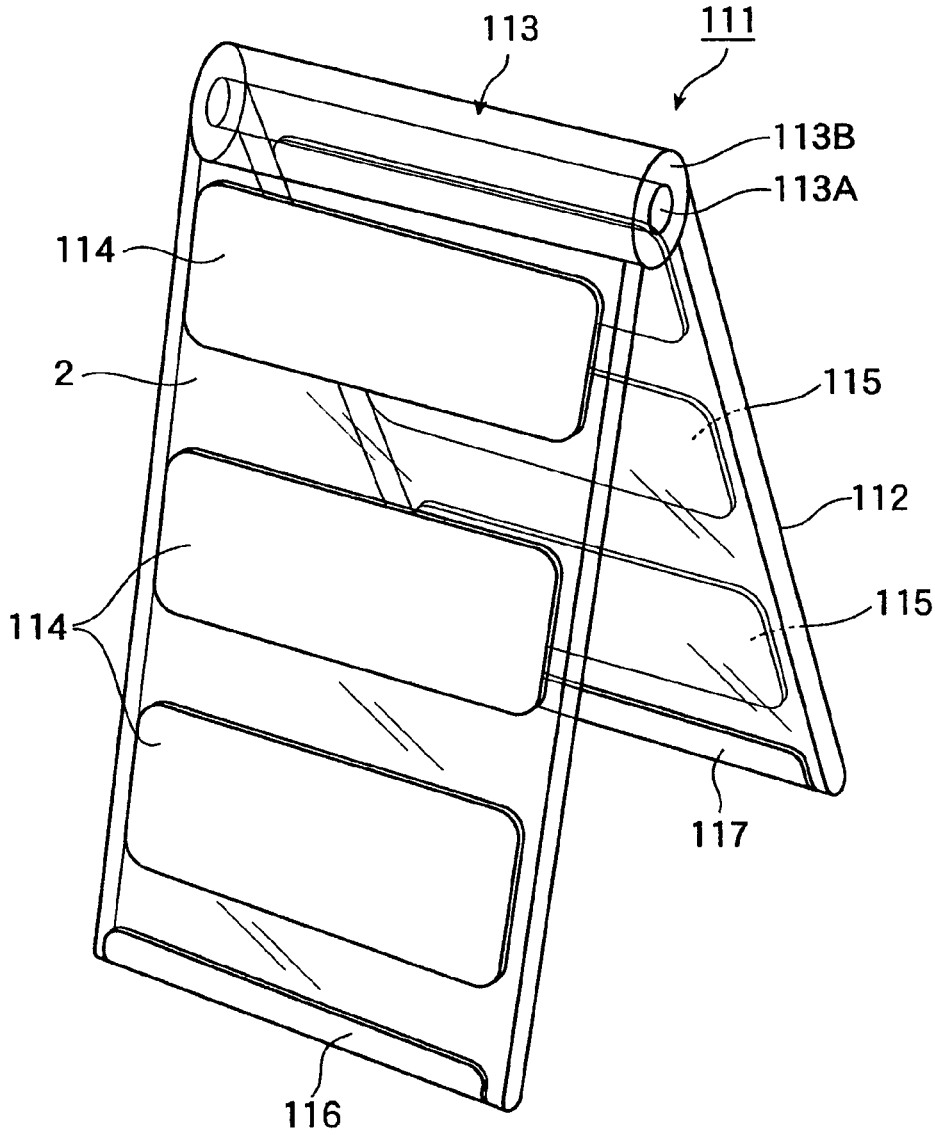
FIG. 16 is a perspective view illustrating the tenth example of the article support according to this invention.
Figure 17:
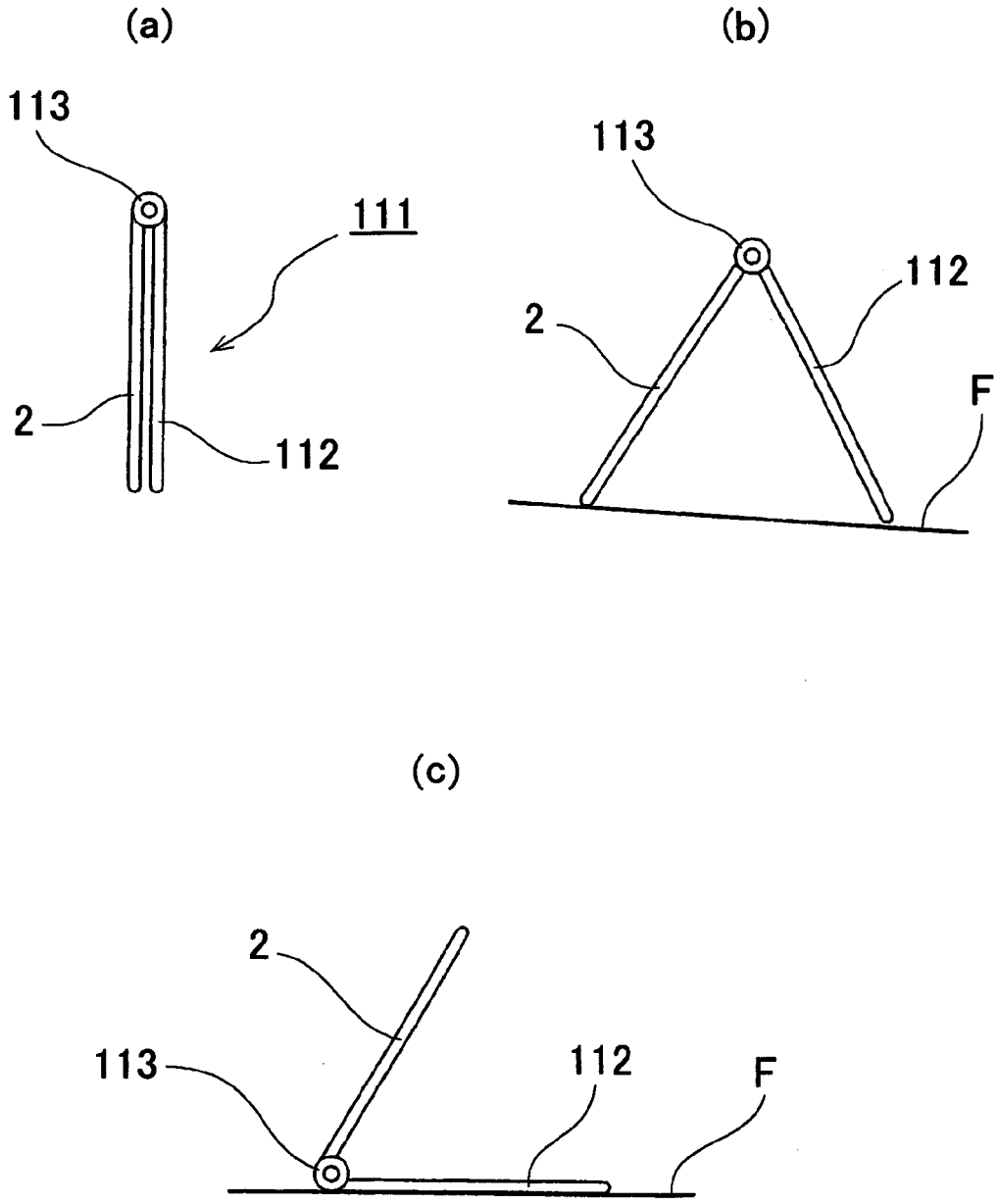
FIG. 17 are side elevations explaining a storage state (a), and application states (b) and (c) of the article supports shown in FIG. 16.

FIG. 16 and FIG. 17 are drawings for explaining the tenth example of the article support according to this invention. An article support 111 shown in the drawings is provided with a supporting plate 2 and a second supporting plate 112 formed in size about equal to the supporting plate 2, and the both supporting plates 2 and 112 are connected rotatably through a hinge 113 at the upper ends thereof. In the hinge 113, a shaft 113A and an outer cylinder 113B are in contact with each other under the predetermined frictional force, and so designed as to maintain the desired relative position between the supporting plates 1 and 112. Furthermore, the both supporting plates 2 and 112 are provided with sheet-like shaped three slide stoppers 114 and 115, and further provided with slide stoppers 116, 117 ranging from the front surface to the lower end face thereof.

In the aforementioned article support 111, the holding means is composed mainly by the hinge 113 for maintaining the supporting plate 2 in the predetermined position and maintaining the supporting plate 2 at desired angle variably.

This article support 111 is structured very simply, and can be stored compactly by putting the reverse faces of the both supporting plates 2 and 112 together as shown in FIG. 17(*a*), and possible support the article by properly regulating the angle between the both plates 2 and 112 and standing its own body on the setting plane F as shown FIG. 17(*b*), and it is also possible to stand the supporting plate 2 by contacting the second supporting plane 112 with the setting plane F as shown in FIG. 17(*c*). Furthermore, if the hinge 113 is offset on the reverse face side of the both supporting plates 2, 112, it is possible to range the both surface in one plane by enlarging the angle between the both supporting plates 2 and 112 into 180 degree, and also possible to support the larger article by leaning the stretched article support 111 against the other structure in this state.

Additionally, the article support according to this invention is not limited to the aforementioned examples in the concrete structure, it is possible to change, for example, the supporting plate in the shape, colour and so, as a matter of course, and further possible to combine the construction of the respective examples and properly change particulars of the holding means.

INDUSTRIAL APPLICABILITY

According to the article support of the present invention, fixing means such as adhesives, clips or so becomes unnecessary, therefore it is possible to attach and remove the article very easily and possible to securely support the attached article. In a case of using as a display stand for POP, it is possible to exhibit commodities in the position very easy to be observed by setting the commodities on the supporting plate maintained in the inclined state and easy to ascertain the commodities by taking them by hands as the fixing means is not used entirely. Especially, according to disuse of the clip, the commodities can be exhibited in all aspects thereof, and it is possible to cope with the commodities of various size and shapes. Further, it is possible to use not only as the display stand for POP, but also as a supporting table of sheets, boards or a table for placing small articles such as glasses, a wrist watch and so on, for example, therefore possible to remarkably expand the application range for the various kinds of articles.

According to the preferred embodiment of the article support of the present invention, it is possible to change a position of the supporting plate according to the size, weight, shape and the like of the article, possible to further expand the application range for the various kinds of the articles, and possible to select display form among the various variation of exhibition of the commodities and further improve the effect of the exhibition in the case of using the article support as the display stand for POP.

Further, according to the preferred embodiment of the article support of the present invention, it is possible to support the article(s) at two portions, that is the supporting plate and the second supporting plate, and it is suitable to especially the display stand for POP. When the second supporting plate is placed in the state of contact with the setting plane, the supporting plate can be maintained in further stable state since the second supporting plate is also provided with the slide stopper, and the damage of the setting plane can be prevented since the slide stopper on the second supporting plate is made of resin.

Moreover, according to the preferred embodiment of the article support of the present invention, it is possible to further stably maintain the supporting plate in the inclined state by the slide stopper disposed on the lower end face, and possible to prevent the setting plane from the damage.

Furthermore, according to the preferred embodiment of the article support of the present invention, it becomes possible to manufacture the supporting plate provided with the slide stopper having various shapes and size easily in large quantities and it is possible to mass-produce this article support by forming the slide stopper monolithically with the resinous supporting plate through the double shot molding process. Additionally, it is possible to keep good external appearance for a long time without caring that the slide stopper is removed from the supporting plate.

The invention claimed is:

1. An article support comprising a supporting plate with a face to support an article, a second supporting plate with a face to support an article, and a holding means for maintaining said supporting plate and said second supporting plate in any one of a plurality of predetermined positions relative to each other, wherein said supporting plate and said second supporting plate are each provided with a plurality of generally semispherically shaped resinous slide stoppers on the face thereof for supporting a respective one of the articles.

2. An article support as set forth in claim 1, wherein said holding means is sized and configured to maintain the supporting plate and the second supporting plate at any one of various angles relative to each other.

3. An article support as set forth in claim 1, wherein said supporting plate and said second supporting plate are each further provided with at least one peripheral resinous slide stopper at least on a lower end face thereof.

4. An article support as set forth in claim 1, wherein said supporting plate and said second supporting plate are each made of resin, and said slide stoppers are integrally formed with respective ones of the supporting plate and the second supporting plate through a double shot molding process.

5. An article support as set forth in claim 2, wherein said supporting plate and said second supporting plate are each further provided with at least one peripheral resinous slide stopper at least on a lower end face thereof.

6. An article support as set forth in claim 2, wherein said supporting plate and said second supporting plate are each made of resin, and said slide stoppers are integrally formed with respective ones of the supporting plate and the second supporting plate through a double shot molding process.

7. An article support as set forth in claim 3, wherein said supporting plate and said second supporting plate are each made of resin, and said slide stoppers are integrally formed with respective ones of the supporting plate and the second supporting plate through a double shot molding process.

8. The article support as set forth in claim 1 wherein the holding means comprises:

a first ball retainer attached to the supporting plate;

a second ball retainer attached to the second supporting plate; and a connecting bar having opposed ends pivotally connected to respective ones of the ball retainers.

9. The article support as set forth in claim 8 wherein the connecting bar has a pair of connecting balls formed on respective ones of the opposed ends thereof which form ball joints with respective one of the ball retainers.

10. The article support as set forth in claim 9 wherein the connecting balls and the ball retainers are sized and configured relative to each other such that the connecting balls spherically contact respective ones of the ball retainers at a predetermined frictional force adapted to allow each of the connecting balls to be maintained at a prescribed position relative to a respective one of the ball retainers.

11. An article support, comprising:

a supporting plate having a face to support an article and a first retainer disposed on the supporting plate;

a second supporting plate having a face to support an article and a second retainer disposed on the second supporting plate, the supporting plate and the second supporting plate each being provided with a plurality of generally semispherically shaped resinous slide stoppers on the face thereof for supporting an article; and an elongate connecting bar having opposed ends pivotally connected to respective ones of the retainers;

the connecting bar and the first and second retainers being sized and configured to frictionally maintain the supporting plate and the second supporting plate in any one of a plurality of prescribed positions relative to each other.

12. The article support as set forth in claim 11 wherein the connecting bar has a pair of connecting balls formed on respective ones of the opposed ends thereof which form ball joints with respective one of the retainers.

13. The article support as set forth in claim 11, wherein the supporting plate and said second supporting plate are each further provided with at least one peripheral resinous slide stopper at least on a lower end face thereof.

14. The article support as set forth in claim 13, wherein the supporting plate and said second supporting plate are each made of resin, and said slide stoppers are integrally formed with respective ones of the supporting plate and the second supporting plate through a double shot molding process.

* * * * *